US006615926B2

(12) United States Patent
Hester et al.

(10) Patent No.: US 6,615,926 B2
(45) Date of Patent: Sep. 9, 2003

(54) ANNULAR FLOW RESTRICTOR FOR ELECTRICAL SUBMERSIBLE PUMP

(75) Inventors: Steve E. Hester, Tulsa, OK (US); Michael Gary Gagner, Owasso, OK (US); Ernesto Alejandro Vilcinskas, Claremore, OK (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/956,270

(22) Filed: Sep. 19, 2001

(65) Prior Publication Data

US 2002/0033266 A1 Mar. 21, 2002

Related U.S. Application Data

(60) Provisional application No. 60/234,057, filed on Sep. 20, 2000.

(51) Int. Cl.[7] ..... E21B 43/12

(52) U.S. Cl. ..... 166/370; 166/66.4; 166/106; 166/133; 166/188; 166/373; 166/386; 166/387

(58) Field of Search ..... 166/265, 370, 166/373, 386, 387, 51, 66.4, 105.5, 106, 133, 129, 183, 188

(56) References Cited

U.S. PATENT DOCUMENTS

| | | | | |
|---|---|---|---|---|
| 2,833,222 A | | 5/1958 | Hansen | 103/113 |
| 4,126,406 A | | 11/1978 | Traylor et al. | 417/373 |
| 4,615,389 A | * | 10/1986 | Neely et al. | 166/250.01 |
| RE32,831 E | * | 1/1989 | Shonrock et al. | 166/135 |
| 5,069,286 A | * | 12/1991 | Rosensch et al. | 166/312 |
| 5,154,588 A | | 10/1992 | Freet et al. | 417/423.3 |
| 5,207,273 A | | 5/1993 | Cates et al. | 166/369 |
| 5,262,065 A | | 11/1993 | Hansen | 210/747 |
| 5,271,725 A | | 12/1993 | Freet et al. | 417/423.3 |
| 5,316,081 A | * | 5/1994 | Baski et al. | 166/188 |
| 5,554,897 A | | 9/1996 | Martin et al. | 310/54 |
| 6,260,626 B1 | * | 7/2001 | Rivas | 166/369 |
| 6,352,111 B1 | * | 3/2002 | Bode et al. | 166/265 |
| 6,457,522 B1 | * | 10/2002 | Bangash et al. | 166/267 |

FOREIGN PATENT DOCUMENTS

| | | |
|---|---|---|
| DE | 3705840 A1 | 9/1988 |
| GB | 2336474 A | 10/1999 |

* cited by examiner

*Primary Examiner*—David Bagnell
*Assistant Examiner*—Zakiya Walker
(74) *Attorney, Agent, or Firm*—Bracewell & Patterson, L.L.P.

(57) ABSTRACT

A method of pumping well fluid from a well having casing with perforations includes connecting an electrical motor to a lower end of a pump and securing the pump to tubing. A restrictor is mounted to the tubing above the pump, the restrictor having a restrictor passage. The well annulus contains a well fluid with a static level under static conditions. When the motor is started to cause the pump to operate, downward flow of well fluid contained in the well annulus flows through the restrictor passage. This reduces the amount of downward flow to increase well fluid flow through the perforations.

30 Claims, 3 Drawing Sheets

Inflow Performance Curve (IPR)

ANNULAR FLOW RESTRICTOR FOR ELECTRICAL SUBMERSIBLE PUMP

This application claims the benefit of provisional application Ser. No. 60/234,057, filed Sep. 20, 2000.

TECHNICAL FIELD

This invention relates in general to electrical submersible pumps and in particular to a restrictor for reducing downward flowing casing annulus well fluid during the initial start-up.

BACKGROUND

In a well, a static fluid level is established while the well is not being produced. This level is a function of the reservoir pressure at the well bore perforations. If this level is above the wellhead (ground level), it is a flowing well. If the level is below the wellhead, it is a dead well and requires artificial lift to flow.

FIG. 8 represents an example of an inflow performance relationship. It plots pressure at the perforations versus flow from the well. The pressure at the perforations could also be plotted as a fluid level (or fluid over the perforations ratio), as shown on the right scale of FIG. 8.

When an artificial lift system, such as an electrical submersible pump (ESP) is started, it adds pressure to the fluid so that it flows to the surface at a predicted flow rate. Before start-up of the ESP, the well bore is at a static condition with the well bore fluids stabilized in the well bore at a static fluid level. After the ESP is started and it has reached its design point, the well bore fluids are stabilized at a flowing fluid level. This drawdown follows the IPR curve in FIG. 8.

Between start and well bore stabilization, the fluid level is moving from the static level to the flowing level. This is called "annulus drawdown". Therefore, the annulus volume has to be reduced or pulled down to its flowing fluid level. On start-up, almost all of the fluid being pumped is from the annulus above the pump intake, with only a small amount coming through the well bore perforations. As the annulus is drawn down, the flow from the annular volume decreases and the flow from the well bore perforations increases. The rate of this transfer is dependent upon the well annular volume (casing ID to tubing and equipment OD and the annular drawdown length) and the pumping flow rate.

At startup, the flow from the perforations upward past the motor to the pump intake will be zero or very low. The motor depends upon fluid flow by its skin to carry heat away. If this flow is too low, for too long a period, excessive heat can build up internally in the motor, causing damage or failure. This is especially true in wells which produce heavy, or viscous oil.

FIG. 9 shows graphically the heat rise in the motor, flow from perforations (flow by the motor), and annular flow to the surface versus time. In this example, the reduced cooling flow by the motor causes the motor to reach 480+ degrees F. in about 33 minutes. The drawdown to well bore stabilization takes over 583 minutes. In some wells, the transition time from start-up to steady state conditions may be as long as two days.

DETAILED DESCRIPTION OF THE INVENTION

Figure 1:
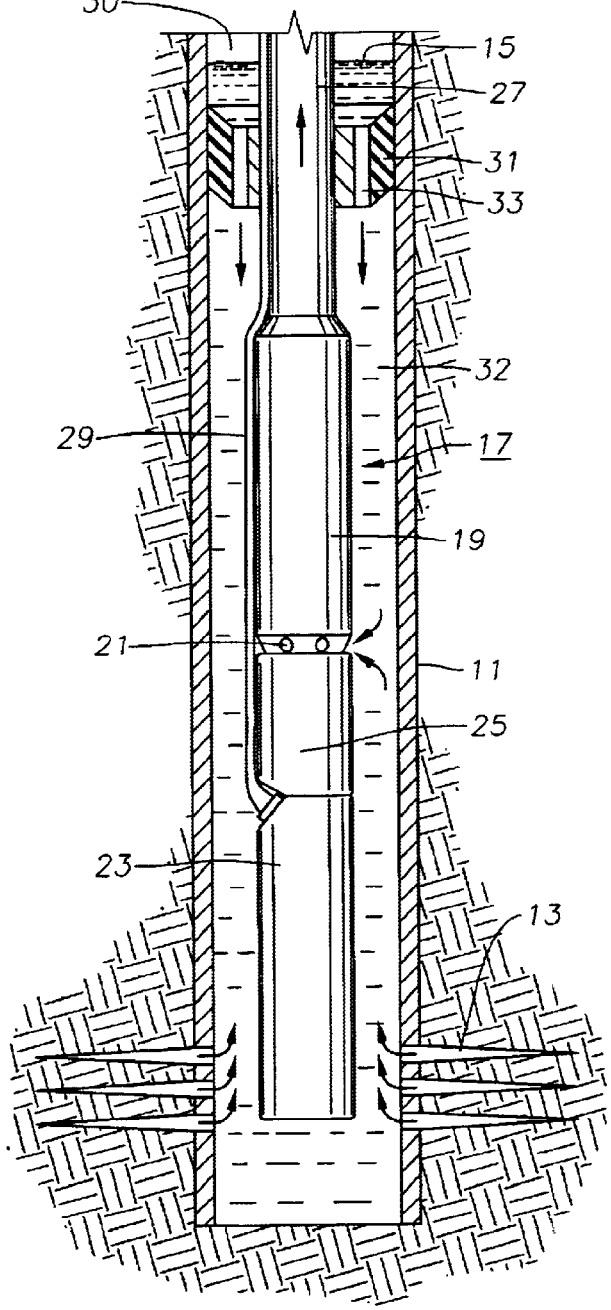
FIG. 1 is a schematic side view of an electrical submersible pump assembly, showing a tubing annulus flow restrictor in accordance with this invention.

Referring to FIG. 1, the well has a casing 11 containing perforations 13. Well fluid flows in through perforations 13, and if not pumped, will reach a static level 15 below the top of the well. Static level 15 could be only a short distance above perforations 13, or it could be thousands of feet above perforations 13.

An electrical submersible pump assembly ("ESP") 17 is installed in casing 11. ESP 17 includes a centrifugal pump 19. Pump 19 is made up of a large number of impellers and diffusers in a conventional manner. Pump 19 has an intake 21 at its base. An electrical motor 23 is part of ESP 17 and drives pump 19. Motor 23 is normally a three-phase induction electrical motor that drives a shaft in pump 19. A seal section 25 locates between pump 19 and motor 23 for equalizing the hydrostatic pressure of the well fluid with internal lubricant located in the motor. ESP 17 may also have a gas separator (not shown) that separates gas from well fluid and discharges it into casing 11.

ESP 17 is suspended on tubing 27 that secures to the upper end of pump 19. Tubing 27 is normally production tubing, made up of sections of steel pipe screwed together. A power cable 29 extends from the surface to motor 23 for supplying power. Power cable 29 will extend alongside and be strapped to tubing 27. A tubing annulus 30 is located around tubing 27 within casing 11. Similarly, a pump annulus 32 surrounds pump 19 within casing 11. Normally, pump 19 is of larger diameter than tubing 27, thus pump annulus 32 will be smaller in cross-sectional flow area than tubing annulus 30. Pump annulus 32 and tubing annulus 30 may be considered to be separate parts of a well annulus.

A flow restrictor 31 is placed in tubing annulus 30 for restricting flow of well fluid down pump annulus 32 into intake 21 during start-up. Restrictor 31 is a blocking member sized so that the suction created by the start-up of pump 19 will draw more well fluid from perforations 13 than from the well fluid in tubing annulus 30. In the embodiments of FIGS. 1–3 and 5–7, the restrictor is placed about 50 to 100 feet above pump 19. Restrictor 31, as well as those in the other embodiments, provides a downward flow area that is less than the minimum flow area in pump annulus 32. The minimum flow area in pump annulus 32 is normally around motor 23, which is typically larger in diameter than pump 19. The maximum downward flow rate through restrictor 31, as well as the restrictors of the other embodiments, is a fraction of the discharge flow rate of pump 19, preferably about 5% to 50%.

In the embodiment of FIG. 1, restrictor 31 is similar to a swab cup, having an elastomeric portion that slidingly engages the inner wall of casing 11 while ESP 17 is being lowered into the well. The orientation of restrictor 31 allows upward flow past the sealing surfaces as it is being lowered, but not downward flow. However, it has a plurality of orifices or passages 33 that extend through it for allowing a maximum flowrate of downflow from tubing annulus 30. The flowrate is selected to be small enough such that most of the well fluid flowing into pump intake 21 will be from perforations 13. Additionally, passages 33 allow any gas that is discharged by a gas separator (not shown in FIG. 1) into casing 11 to flow up past restrictor 31. There are no check valves in passages 33, allowing fluid flow in both upward and downward directions.

In operation, there will be a static fluid level 15 when pump 19 is not operating. Static fluid level 15 will normally be above restrictor 31. Once pump 19 begins operating, formation fluid from perforations 13 will begin flowing into pump intake 21. At the same time, static fluid level 15 will begin dropping. Well fluid in tubing annulus 30 will flow downward through passages 33 toward intake 21, but at a lower flow rate than would exist if no restriction were present. The restriction provided by restrictor 31 enhances flow out of perforations 13 over the prior art, which has no type of restrictor 31. The decreased downward flow rate increases the drawdown period before the well fluid in tubing annulus 30 reaches a constant fluid level with pump 19 operating, but increases cooling flow by motor 23 during the initial starting period. Eventually, static fluid level 15 will drop to a constant level even though pump 19 is operating, with downward flow from tubing annulus 30 ceasing. This constant level while pump 19 is operating may be either above restrictor 31 or below.

Figure 2:
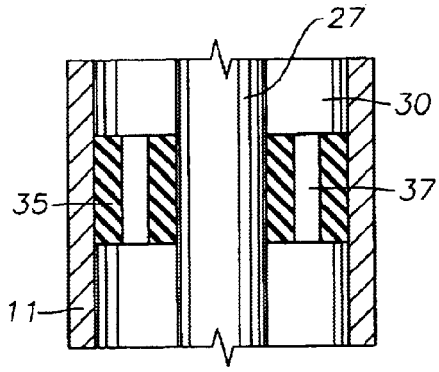
FIG. 2 is a view of an upper portion of the pump assembly of FIG. 1, showing a first alternate embodiment of a restrictor.

Rather than a swab cup type restrictor 31, various other blocking members could be utilized. For example, the diameter of tubing 27 between the discharge of pump 19 and the static fluid level 15 could be increased. This decreases the cross-sectional flow area of tubing annulus 30 in that area, reducing the downward flow during start-up. Also, as shown in FIG. 2, an inflatable packer 35 could be utilized having orifices 37 for upward and downward flow. Packer 35 would be inflated in a conventional manner during installation of ESP 17.

Figure 3:
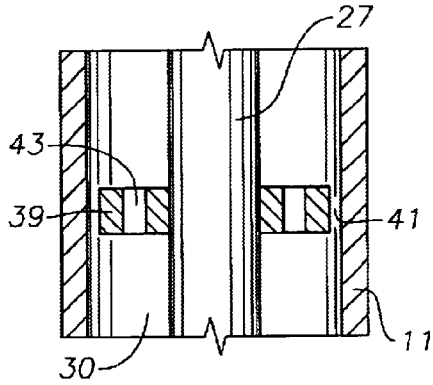
FIG. 3 is a schematic view of an upper portion of the pump assembly of FIG. 1, showing a second alternate embodiment of a restrictor.

In the embodiment of FIG. 3, a rigid plate 39 is mounted to tubing 27 above pump 19 (FIG. 1) and below static fluid level 15. An annular clearance 41 is located between plate 39 and the inner diameter of casing 11. Annular clearance 41 allows some downward flow of fluid from tubing annulus 30. Furthermore, plate 39 has orifices 43 sized for allowing only a selected rate of downward flow during start-up. Orifices 43 also allow upward flow.

Figure 4:
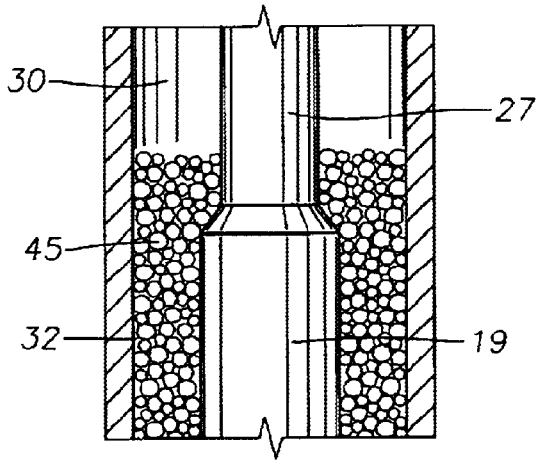
FIG. 4 is sectional view of an upper portion of the pump assembly of FIG. 1, showing a third alternate embodiment of a restrictor.

In the embodiment of FIG. 4, the restriction comprises aggregate 45 placed in tubing annulus 30. Aggregate 45, basically gravel, could also be placed around pump 19 in pump annulus 32. Aggregate 45 reduces the flow rate of well fluid in tubing annulus 30.

Figure 5:
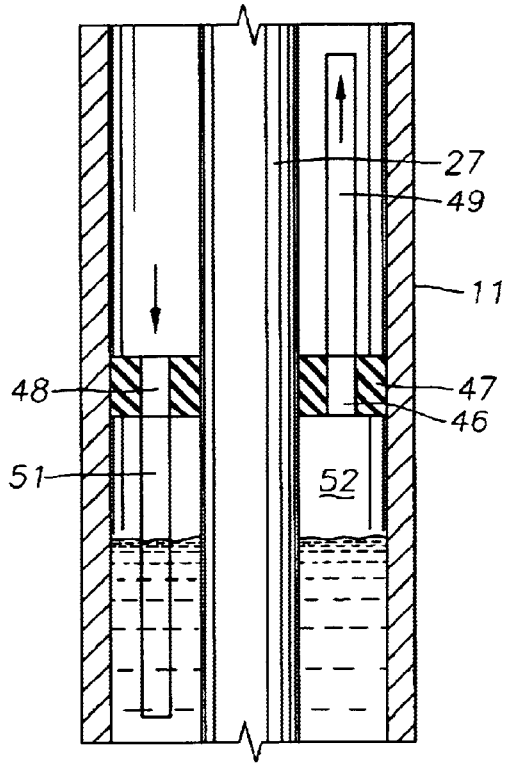
FIG. 5 is a sectional view of an upper portion of the pump assembly of FIG. 1, showing a fourth alternate embodiment of a restrictor.

The embodiment of FIG. 5 is particularly useful for wells that produce significant amounts of gas. Blocking member 47 may be either a packer such as packer 35 of FIG. 2, or it may be a swab cup type elastomer such as restrictor 31 of FIG. 1. Blocking member 47 has at least two passages, with passage 46 being primarily for upward gas flow and passage 48 being for downward liquid flow of well fluid in the tubing annulus. Gas flow passage 46 is connected to a tube 49 that extends upward, and well fluid passage 48 is connected to a tube 51 that extends downward. Preferably, tube 49 extends above the static fluid level 15 (FIG. 1), although this is not necessary. Tube 51 extends downward far enough to be below any gas cap 52 that may form below the lower end of blocking member 47. Tube 51 serves to bleed off gas in gas cap 52 to prevent it from growing to a size large enough to affect the intake of liquid into the pump intake 21 (FIG. 1). Locating the upper end of tube 49 above restrictor 47 reduces the amount of liquid flowing downward in tube 49, which might otherwise impede the upward flow of gas. Similarly, tube 51 reduces downward flowing liquid in the vicinity of the inlet to gas flow passage 46, which might otherwise obstruct the flow of gas. There are no valves in either passage 46, 48 that would prevent upward or downward flow of fluid.

Figure 6:
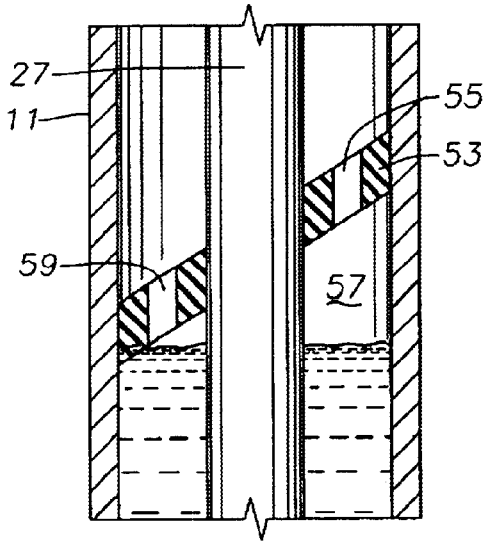
FIG. 6 is a sectional view of an upper portion of the pump assembly of FIG. 1, showing a fifth alternate embodiment of a restrictor.

FIG. 6 also discloses an embodiment for facilitating the upward flow of gas while restricting the downward flow of liquid. Blocking member 53 is an annular member mounted to tubing 27 so as to provide a lower end that is configured to create a gas pocket 57 along one side. In this embodiment, gas pocket 57 is created by tilting blocking member 53 so that portion of the lower end is higher than another portion. A gas flow passage 55 extends upward through blocking member 53 from the portion above gas pocket 57. A well fluid passage 59 extends through a lower portion of blocking member 53 for the downward flow of well fluid. Both passages 55 and 59 are capable of two-way flow, however gas will tend to flow through gas flow passage 55 because of its location over gas pocket 57.

Figure 7:
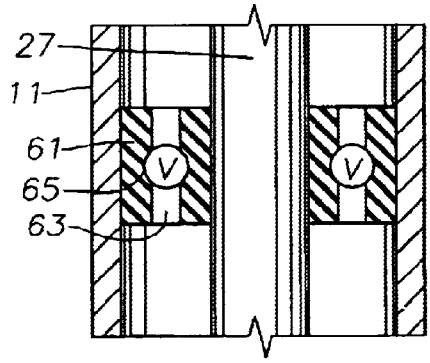
FIG. 7 is a sectional view of an upper portion of the pump assembly of FIG. 1, showing a sixth alternate embodiment of a restrictor.
Figure 8:
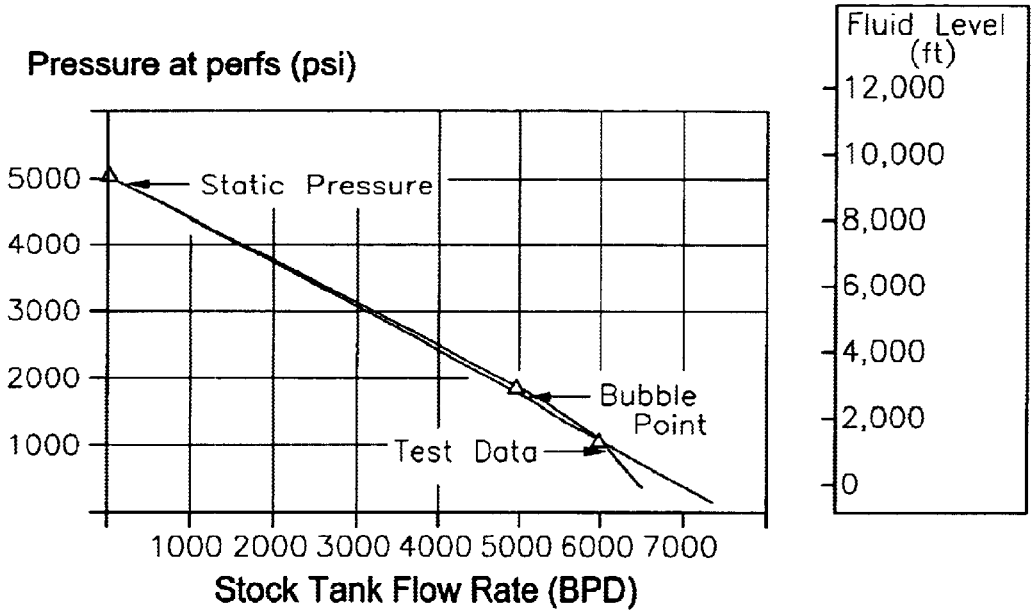
FIG. 8 is a graph of pressure of a typical well at the perforations versus flow from the pump.
Figure 9:
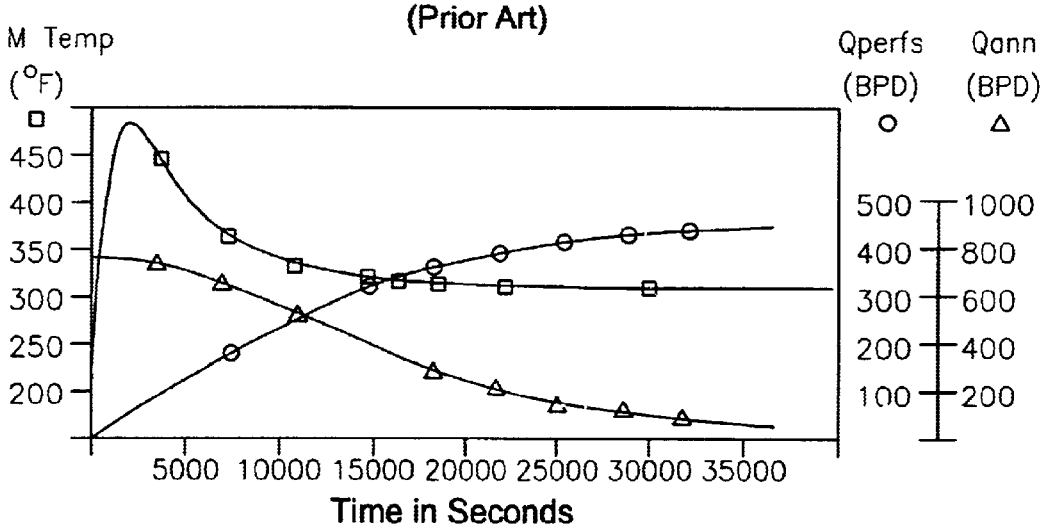
Fig. 9 (Prior Art)
FIG. 9 is a graph of a typical rise in temperature of an electrical motor of an electrical submersible pump of a prior art assembly and installation.

FIG. 7 shows another embodiment for restricting downward flow. Blocking member 61 may be either a packer such as in FIG. 2 or an elastomer as in FIG. 1. Blocking member 61 has one or more passages 63 that allow downward flow of well fluid as well as upward flow. A pressure responsive variable orifice valve 65 is in each passage 63. Each valve 65 will reduce the flow area through passage 63 in response to an increase in differential pressure across blocking member 61. Valve 65 constricts the flow rate of downward flowing well fluid in proportion to the extent of draw down due to the initial operation of pump 19 (FIG. 1). If there is a fairly high static fluid level, when pump 27 starts to operate, a fairly large pressure differential across blocking member 61 may occur. If so, valves 65 will reduce the flow area accordingly to prevent a high flow rate of well annulus fluid from flowing downward. Valve 65 preferably is not electrically actuated. Rather it preferably has a resilient portion within its passage that deforms in response to pressure differential to reduce and increase the passage.

The invention has significant advantages. Restricting downward flow of well annulus fluid allows more flow through the perforations. The increased flow through the perforations flows past the motor, cooling it.

While the invention has been shown in several of its forms, it should be apparent that the invention is not so limited, but is susceptible to various changes without departing from the scope of the invention.

What is claimed is:

1. A method of pumping well fluid from a well having casing with perforations by using a pump assembly that includes a pump having an intake defining a flowpath from the perforations to the intake, the pump being coupled to a downhole motor that is suspended in the flowpath upstream of the intake of the pump, the pump assembly being suspended on and discharging well fluid into a string of tubing, the string of tubing and the pump assembly being surrounded by a well annulus, the method comprising:

(a) shutting off the motor and allowing well fluid from the perforations to rise in the well annulus to a static level;

(b) starting the motor to cause the pump to operate; then (c) reducing downward flow of the well fluid in the well annulus to the intake by an amount sufficient to increase well fluid flow through the perforations past the motor for cooling the motor during initial starting of the pump.

2. The method of claim 1, wherein step (c) comprises placing a restrictor above the intake of the pump, the restrictor defining at least one passage that communicates with the well annulus above and below the restrictor, the method comprising causing at least some of the well fluid flowing downward in the well annulus to flow through the passage of the restrictor.

3. The method of claim 1, wherein step (c) comprises placing an elastomer in the well annulus above the intake of the pump that sealingly engages the casing and has at least one passage therethrough that communicates with the well annulus above and below the elastomer, the method comprising causing at least some of the well fluid flowing downward in the well annulus to flow through the passage of the elastomer.

4. The method of claim 1, wherein step (c) comprises setting an inflatable packer in the casing that sealingly engages the casing above the intake of the pump and has at least one passage therethrough that communicates with the well annulus above and below the packer, the method comprising causing at least some of the well fluid flowing downward in the well annulus to flow through the passage of the packer.

5. The method of claim 1, wherein step (c) comprises placing a rigid plate in the well annulus above the intake of the pump that has at least one passage therethrough that communicates with the well annulus above and below the plate, the method comprising causing at least some of the well fluid in the well annulus that is flowing downward to flow through the passage in the plate.

6. The method of claim 1, wherein step (c) comprises placing a rigid plate in the well annulus above the intake of the pump that has a circumference spaced inward from a bore of the casing, defining an annular clearance between the circumference of the plate and the bore of the casing, causing at least some of the well fluid in the well annulus that is flowing downward to flow through the annular clearance.

7. The method of claim 1, wherein step (c) comprises placing an aggregate fill in the well annulus, at least part of the aggregate fill being above an intake of the pump, the method comprising causing at least some of the well fluid in the well annulus that is flowing downward to flow through the aggregate fill.

8. The method of claim 1, wherein step (c) comprises placing an aggregate fill in the well annulus around the pump assembly at a point spaced above the perforations, the method comprising causing the well fluid in the well annulus that is flowing downward to flow through the aggregate fill while the flowpath between the intake and the perforations remains unrestricted to avoid reducing flow of well fluid from the perforations past the motor.

9. The method of claim 1, wherein step (c) comprises placing a blocking member in the well annulus above an intake of the pump, the blocking member having a well fluid passage therethrough with a tube extending downward therefrom in communication with the well annulus below the blocking member for allowing the downward flow of the well fluid into the well annulus, and a gas flow passage extending therethrough with a gas flow tube extending upward from the blocking member in communication with the well annulus above the blocking member for upward flow of gas, the method comprising causing at least some of the well fluid flowing downward in the well annulus to flow through the well fluid passage and causing gas flowing in from the perforations to flow upward through the gas flow tube.

10. The method of claim 1, wherein step (c) comprises placing a blocking member in the well annulus above an intake of the pump, the blocking member having a well fluid passage therethrough with a tube extending downward therefrom in fluid communication with the well annulus above the blocking member, the method comprising causing at least some of the well fluid flowing downward in the well annulus to flow through the well fluid passage.

11. The method of claim 1, wherein step (c) comprises placing a blocking member in the well annulus above an intake of the pump, the blocking member having a well fluid passage therethrough with a tube extending upward therefrom in fluid communication with the well annulus above the blocking member, the method comprising causing gas that might be contained in the well fluid below the blocking member to flow upward through the well fluid passage.

12. A method of pumping well fluid from a well having casing with perforations by using a pump assembly that includes a pump coupled to a downhole motor, the pump assembly being suspended on and discharging well fluid into a string of tubing, the string of tubing and the pump assembly being surrounded by a well annulus that contains well fluid under static conditions when the pump is not operating, the method comprising:

(a) starting the motor to cause the pump to operate; then (b) restricting downward flow of well fluid in the well annulus by an amount sufficient to increase well fluid flow through the perforations during initial starting of the pump; and wherein step (b) comprises placing a blocking member in the well annulus above an intake of the pump, the blocking member having a lower end with a gas pocket portion elevated above a well fluid portion, the blocking member having a well fluid passage through the well fluid portion and a gas flow passage through the gas pocket portion, the method comprising causing at least some of the well fluid flowing downward through the well annulus to flow through the well fluid passage, and causing gas flowing in from the perforations to flow to the gas pocket portion and upward through the gas flow tube.

13. A method of pumping well fluid from a well having casing with perforations by using a pump assembly that includes a pump coupled to a downhole motor, the pump assembly being suspended on and discharging well fluid into a string of tubing, the string of tubing and the pump assembly being surrounded by a well annulus that contains well fluid under static conditions when the pump is not operating, the method comprising:

(a) starting the motor to cause the pump to operate; then (b) restricting downward flow of well fluid in the well annulus by an amount sufficient to increase well fluid flow through the perforations during initial starting of the pump; and wherein step (b) comprises placing a blocking member in the well annulus above an intake of the pump, the blocking member having a passage therethrough for allowing the downward flow of the well fluid, and a pressure responsive variable orifice valve in the passage of the blocking member, the method comprising decreasing the flow area through the passage in the blocking member with the valve in response to an increase in pressure differential across the blocking member.

14. A method of pumping well fluid from a well having casing with perforations, comprising:

(a) connecting an electrical motor to a lower end of a pump;

(b) securing the pump to tubing;

(c) mounting a restrictor to the tubing above an intake of the pump, the restrictor having a restrictor passage therethrough in communication with a well annulus above and below the restrictor;

(d) lowering the tubing, restrictor, and pump into the well, the well annulus containing a well fluid that has flowed from the perforations to a static level above the restrictor under static conditions;

(e) starting the motor to cause the pump to operate; then (f) restricting downward flow of the well fluid contained in the well annulus above the restrictor by causing at least some of the well fluid to flow through the restrictor passage to the pump to increase well fluid flow through the perforations.

15. The method according to claim 14, wherein step (c) comprises mounting an annular elastomer to the tubing that sealingly engages the casing as the tubing is lowered into the casing.

16. The method according to claim 14, wherein step (c) comprises mounting a packer to the tubing, and step (d) comprises lowering the packer into the casing in a collapsed configuration, then setting the packer.

17. The method according to claim 14, wherein step (c) comprises mounting an annular rigid plate to the tubing, the plate having an outer diameter that is less than an inner diameter of the casing, defining an annular clearance between the plate and the casing through which the well fluid in step (f) flows.

18. The method according to claim 14, wherein step (c) comprises mounting a well fluid tube to the restrictor passage and extending the well fluid tube downward therefrom in communication with the well annulus above and below the restrictor, the restrictor further having a gas flow passage with a gas flow tube joining the gas flow passage and extending upward therefrom, the method further comprising causing gas flowing through the perforations to flow upward through the gas flow tube.

19. A method of pumping well fluid from a well having casing with perforations, comprising:

(a) connecting an electrical motor to a lower end of a pump;

(b) securing the pump to tubing;

(c) mounting a restrictor to the tubing above an intake of the pump, the restrictor having a restrictor passage therethrough;

(d) lowering the tubing, restrictor, and pump into the well, defining a well annulus that contains a well fluid with a static level under static conditions;

(e) starting the motor to cause the pump to operate; then (f) restricting downward flow of well fluid contained in the well annulus by causing at least some of the well fluid to flow through the restrictor passage to increase well fluid flow through the perforations; and wherein step (c) comprises providing the restrictor with a lower end that has a gas pocket portion spaced above a well fluid portion, the restrictor passage extending upward from the well fluid portion of the lower end, the restrictor further having a gas flow passage that extends through the restrictor from the gas pocket portion, the method further comprising causing gas flowing through the perforations to collect in the gas pocket portion and flow upward through the gas tube.

20. A method of pumping well fluid from a well having casing with perforations, comprising:

(a) connecting an electrical motor to a lower end of a pump;

(b) securing the pump to tubing;

(c) mounting a restrictor to the tubing above an intake of the pump, the restrictor having a restrictor passage therethrough;

(d) lowering the tubing, restrictor, and pump into the well, defining a well annulus that contains a well fluid with a static level under static conditions;

(e) starting the motor to cause the pump to operate; then (f) restricting downward flow of well fluid contained in the well annulus by causing at least some of the well fluid to flow through the restrictor passage to increase well fluid flow through the perforations; and wherein step (c) comprises providing the restrictor with a pressure responsive variable orifice valve, the method further comprising reducing the flow area in the restrictor passage in response to an increase in the differential pressure across the restrictor.

21. In a well having a casing with a set of perforations in communication with an earth formation and a string of tubing suspended in the casing, an apparatus for pumping well fluid from the well, comprising:

a pump assembly that includes a downhole motor located below a pump having an intake, the pump assembly being suspended on the tubing, the tubing and the pump assembly defining a well annulus, the motor being located upstream from the intake of the pump in a flowpath leading from the perforations to the intake;

a well fluid in the well annulus that originates in the earth formation and rises to a static level under static conditions due to internal pressure in the earth formation; and a restrictor located in the well annulus above the intake of the pump and below the static level of the well fluid under static conditions, the restrictor partially blocking downward flow of the well fluid from the well annulus to the intake to increase well fluid flow through the perforations and past the motor during initial starting of the pump assembly.

22. The well according to claim 21, wherein the restrictor comprises an annular blocking member mounted to the string of tubing and having at least one passage therethrough in fluid communication with the well annulus above and below the blocking member for the downward flow of well fluid.

23. The well of claim 21, wherein the restrictor comprises an annular elastomer mounted to the string of tubing, the elastomer sealingly engaging the casing and having at least one passage therethrough in fluid communication with the well annulus above and below the elastomer for the downward flow of well fluid.

24. The well of claim 21, wherein the restrictor comprises an inflatable packer mounted to the string of tubing, the packer having at least one passage therethrough in fluid communication with the well annulus above and below the packer for the downward flow of well fluid.

25. The well of claim 21, wherein the restrictor comprises a rigid plate mounted to the string of tubing, the plate having at least one passage therethrough in fluid communication with the well annulus above and below the plate for the downward flow of well fluid.

26. The well of claim 21, wherein the restrictor comprises a rigid plate mounted to the string of tubing, the plate having a circumference spaced inward from a bore of the casing, defining an annular clearance between the circumference of the plate and the bore of the casing for flow of the well fluid from the tubing annulus during starting of the motor.

27. The well of claim 21, wherein the restrictor comprises an aggregate in the well annulus spaced above the perforations, and wherein the flowpath from the perforations to the pump intake is free of the aggregate.

28. The well of claim 21, wherein the restrictor comprises a blocking member mounted to the string of tubing, the blocking member having a well fluid passage therethrough with a tube extending downward therefrom in fluid communication with the well annulus above and below the blocking member for allowing downward flow of the well fluid, and a gas flow passage extending therethrough with a gas flow tube extending upward from the blocking member for upward flow of gas.

29. The well of claim 21, wherein the restrictor comprises a blocking member mounted to the string of tubing, the blocking member having a passage therethrough in fluid communication with the well annulus above and below the blocking member for allowing downward flow of the well fluid, and a variable valve in the passage of the blocking member, the valve decreasing a flow area through the passage in response to an increasing pressure differential across the valve.

30. In a well having a casing with a set of perforations and a string of tubing suspended in the casing, an apparatus for pumping well fluid from the well, comprising:

a pump assembly that includes a downhole motor located below a pump, the pump assembly being suspended on the tubing, the tubing and the pump assembly defining a well annulus that contains well fluid under static conditions when the pump assembly is not operating;

a restrictor located in the well annulus above an intake of the pump for restricting downward flow of well fluid from the well annulus to increase well fluid flow through the perforations and past the motor during initial starting of the pump assembly; and wherein the restrictor comprises a blocking member mounted to the string of tubing, the blocking member having a lower end with a gas pocket portion elevated above a well fluid portion, the blocking member having a well fluid passage through the well fluid portion for allowing downward flow of the well fluid, and a gas flow passage through the gas pocket portion for collecting and facilitating upward flow of gas.

* * * * *